United States Patent [19]

Smith

[11] 4,424,968

[45] Jan. 10, 1984

[54] BASKETBALL BACKBOARD APPARATUS

[75] Inventor: Max D. Smith, Evansville, Ind.

[73] Assignee: Indian Industries, Inc., Evansville, Ind.

[21] Appl. No.: 318,487

[22] Filed: Nov. 5, 1981

[51] Int. Cl.[3] ..... A63B 63/08

[52] U.S. Cl. ..... 273/1.5 R; 52/309.11; 52/823; 52/829; 403/408; 428/461

[58] Field of Search ..... 273/1.5 R, 1.5 A, 395; 428/99, 461; 403/408; 52/309.11, 309.14, 309.9, 829, 803, 823; 29/526 A

[56] References Cited

U.S. PATENT DOCUMENTS

| | | | |
|---|---|---|---|
| 1,789,363 | 1/1931 | Gross | 273/1.5 R |
| 2,018,663 | 10/1935 | Fitch | 52/803 |
| 2,247,330 | 6/1941 | Demers | 403/408 |
| 2,267,222 | 12/1941 | Sandeberg | 273/1.5 R |
| 2,704,801 | 3/1955 | Epstein | 29/526 A |
| 2,853,903 | 9/1958 | Rapata | 29/526 X |
| 2,932,516 | 4/1960 | Penner | 273/1.5 R X |
| 3,334,464 | 8/1967 | Charles | 52/309.9 X |
| 3,388,909 | 6/1968 | Woods | 273/1.5 R |
| 3,402,520 | 9/1968 | Lee et al. | 52/309.11 X |
| 3,622,155 | 11/1971 | Hirsch | 273/1.5 R |
| 3,687,496 | 8/1972 | Hindin | 52/785 |
| 3,771,410 | 11/1973 | Swindt | 52/803 X |
| 3,941,027 | 3/1976 | Gibson, Jr. et al. | 403/408 X |
| 4,082,269 | 4/1978 | Hill | 273/1.5 R |
| 4,151,989 | 5/1978 | Dittrich | 273/1.5 A |
| 4,221,041 | 9/1980 | Hofnagl et al. | 29/526 A X |
| 4,259,028 | 3/1981 | Cook | 52/309.9 X |

FOREIGN PATENT DOCUMENTS

| | | | |
|---|---|---|---|
| 53-25976 | 3/1978 | Japan | 29/526 A |

OTHER PUBLICATIONS

Adams Plastics Inc. 1-1980, Backboard Bumpers No. 1800.

GSC Athletic Equipment, Inc., 1-1980, Backboard Padding No. 001-J.

Gared Company Athletic Equipment, 1-1980, Cushion Edge No. CE.

*Primary Examiner*—Paul E. Shapiro

*Attorney, Agent, or Firm*—Woodard, Weikart, Emhardt & Naughton

[57] ABSTRACT

A basketball backboard apparatus is disclosed herein which includes a sandwich board comprising rigid front and rear panels and a resilient intermediate layer received therebetween in a sandwich relationship. Rivets are received through apertures in the sandwich board to secure the board members together, and mounting apertures are also provided for mounting the backboard to an external support and for mounting a basketball goal to the backboard. A relatively soft border is secured about the perimeter of the backboard.

5 Claims, 6 Drawing Figures

BASKETBALL BACKBOARD APPARATUS

BACKGROUND OF THE INVENTION

1. Field of the Invention:

The present invention relates to a basketball backboard apparatus, and more particularly to a backboard which has a novel sandwich construction.

2. Description of the Prior Art:

Various backboard constructions have been provided in the prior art for use in mounting a basketball goal for the game of basketball. The vast majority of such prior art devices have comprised simple, unitary backboards of wood, metal or plastic composition. It is particularly desirable in the game of basketball to provide a backboard which is aesthetically pleasing, durable, and having a strength and resilience to give a proper feel during the game. However, certain prior art backboards such as those of a unitary wood construction or certain other materials may not have the proper feel or give the proper bounce to the basketball during use. Other backboards may not have the desired appearance or sound during use.

Examples of typical backboards provided in the prior art are the following. In U.S. Pat. No. 1,789,363, issued to Gross on Jan. 20, 1931, there is disclosed a wooden basketball backboard having a sheet metal casing which is soldered at the edges. A wooden laminated backboard with canvas and glass material secured thereto is disclosed in U.S. Pat. No. 1,736,879, issued to Gross on Nov. 26, 1929. A variety of other basketball backboards have been proposed which are simply of a unitary metal construction. Examples of such prior art backboards are contained in U.S. Pat. Nos. 3,964,743, issued to Salsich on June 22, 1976; 3,233,897, issued to Sheets on Feb. 8, 1966; 2,363,634, issued to Albach et al. on Nov. 28, 1944; 1,702,510, issued to Jones on Feb. 19, 1929; 2,379,572, issued to Gibson on July 3, 1945; and 1,680,287, issued to Evans on Aug. 14, 1928. A similar device is shown in U.S. Pat. No. 4,005,860, issued to Ebstein et al. on Feb. 1, 1977, which patent also discloses the feature of having bolts received through notches in the mounting brackets to promote the quick mounting and removal of the backboard.

SUMMARY OF THE INVENTION

Briefly described in one aspect of the present invention there is provided a basketball backboard apparatus including a sandwich board of front and rear rigid panels and an intermediate resilient layer received between the panels. Means are provided for securing the panels and intermediate layer together, and a relatively soft border is attached to the perimetric edge of the sandwich board.

It is an object of the present invention to provide a basketball backboard apparatus which is durable in construction and which is attractive looking.

Another object of the present invention is to provide a basketball backboard apparatus which has the proper feel as a backboard.

It is a further object of the present invention to provide a basketball backboard apparatus which has a sturdy construction, and yet which has a relatively soft perimeter.

Another object of the present invention is to provide a basketball backboard apparatus which is constructed of durable and relatively inexpensive materials which may be readily manufactured.

Further objects and advantages of the present invention will become apparent from the description of the preferred embodiment which follows.

DESCRIPTION OF THE PREFERRED EMBODIMENT

Figure 1:
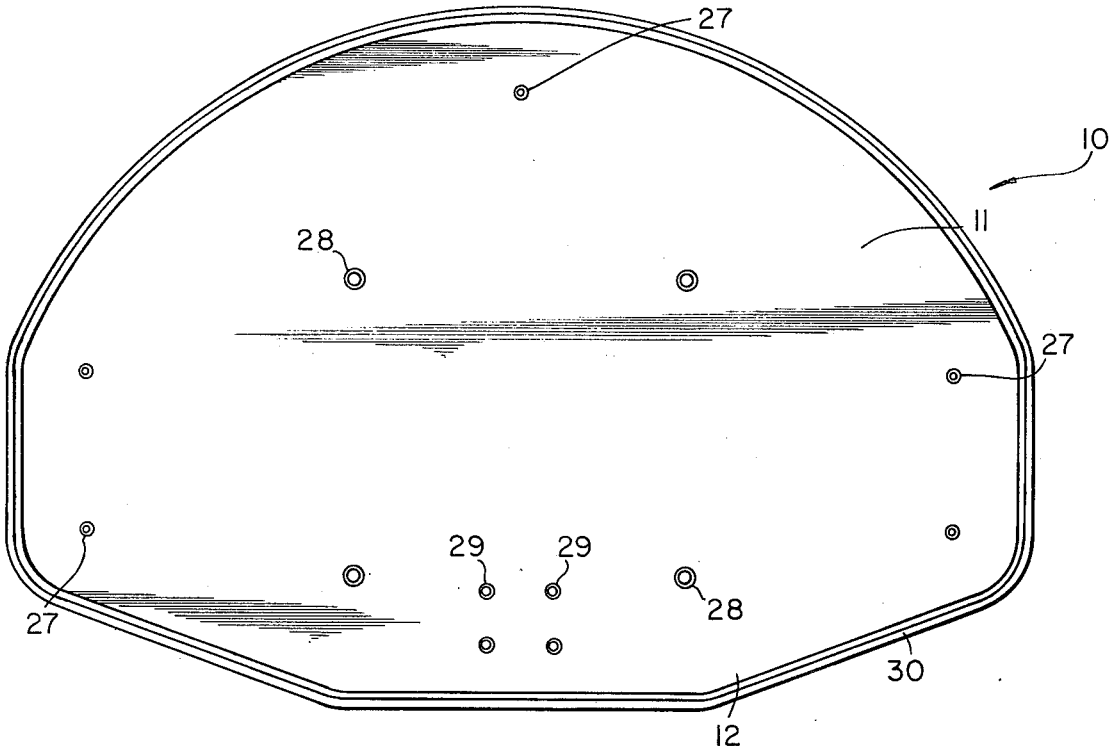
FIG. 1 is a front view of a basketball backboard apparatus constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 5:
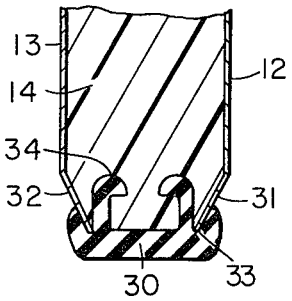
FIG. 5 is a cross-sectional view of the edge portion of the backboard apparatus of FIG. 1, and particularly showing the method of attachment of the perimetric border.

Referring in particular to the drawings, there is shown a basketball backboard apparatus 10 constructed in accordance with the present invention. The backboard apparatus 10 includes a sandwich board 11 shaped in the form of a basketball backboard and having a perimetric edge. Sandwich board 11 includes a front panel 12 and a rear panel 13 spaced-apart therefrom. Positioned between the front and rear panels is an intermediate layer 14 (FIG. 5). As will be further described, means are provided for securing together the front and rear panels and the intermediate layer to form a unitary, sturdy basketball backboard. It is a particular feature of the present invention that the backboard 10 comprises a sandwich board 11 which is durable, provides the proper bounce or feel in use, and is aesthetically pleasing. In this regard, the front and rear panels are rigid members, and may for example preferably comprise heavy gauge steel such as a 20 gauge material. The front and rear panels are desirably coated with a polyester, powder-coating finish which provides a more attractive appearance and will resist chipping and cracking.

The intermediate layer 14 is preferably a resilient material which may also be relatively rigid. A preferred material for the intermediate layer 14 is a rigid, high density polyurethane core which desirably is foamed in place and would have a density, for example, of six pounds per cubic foot. A typical size for the sandwich board 11 is fifty-four inches wide by thirty-six inches high and one and one-eighth inches in thickness.

Figure 3:
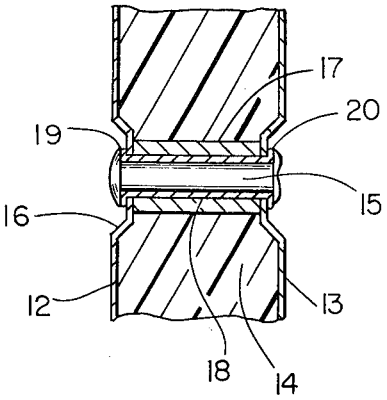
FIG. 3 is a partial, cross-sectional view of the backboard apparatus of FIG. 1, and particularly showing a preferred construction for mounting the backboard to a support.

Securement means are also provided for securing together the front and rear panels and the intermediate layer of the sandwich board 11 in an adjacent, sandwich relationship as shown in the drawings. Referring in particular to FIG. 3, a preferred securement means is shown as including a solid rivet 15 received through an aperture in the sandwich board 11. More particularly, the front and rear panels and intermediate layer define aligned apertures for reception of the rivet, and further include recesses, such as 16, to permit the rivet to be received in the aperture without extending outwardly of the face of the backboard. A sleeve member 17 is received within the sandwich board and a spacing sleeve 18 is received therein. The spacing sleeve 18 includes a first lip portion 19 received adjacent the front panel 12, and a second lip portion 20 which may be formed in the manner of a hollow rivet to be received against the rear panel 13. The solid rivet 15 is then received within the spacer sleeve 18 as shown in FIG. 3. In this fashion, the front and rear panels are held firmly together against the intermediate foam layer 14 to comprise a strong sandwich board unit. It will be appreciated that the foaming in place of the intermediate layer of polyurethane or like material further contributes to the rigidity and integrity of the sandwich panel as a composite, singular unit.

Figure 4:
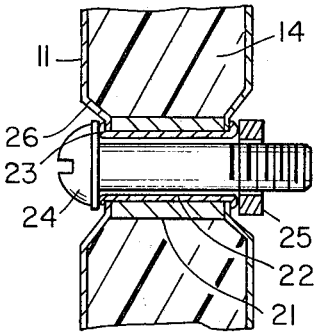
FIG. 4 is a partial, cross-sectional view of the backboard apparatus of FIG. 1, and particularly showing a preferred method for securing together the front and rear panels and intermediate layer.

Similarly, means are provided for securing the backboard 10 to an external support, such as a post or framework. Referring in particular to FIG. 4, a preferred embodiment of this mounting means is shown to include the sandwich board 11 defining mounting apertures extending through the front and rear panels and intermediate layer in a fashion similar to that shown in FIG. 3. The sandwich board includes an outer sleeve 21 positioned within the board and extending between the front panel 12 and the rear panel 13 and preferably being secured thereto. An inner, spacer sleeve 22 is received through the aperture and within the outer sleeve 21, and is secured to the sandwich board with lip portions such as 23 in the same fashion as that described with respect to the inner sleeve 18 of FIG. 3. A bolt 24 or similar fastening device is then received within the aperture defined by the inner sleeve 22, and a spacer 25 is received over the threaded end of the bolt 24. In this fashion, the outside plane of the spacer is preferably in line with the outside surface of the rear panel so that securement of the backboard against a support structure will not place excessive strain at the point of attachment. At the same time, recesses, such as 26, are provided to contain the head of the bolt and the spacer to prevent them from extending outwardly from the front surface of the backboard. The purpose for this recess, as for recess 16 shown in FIG. 3, is to prevent the fastening devices from extending beyond the plane of the backboard to the point that they would interfere with the normal bounce of a basketball off the backboard at that location.

Figure 2:
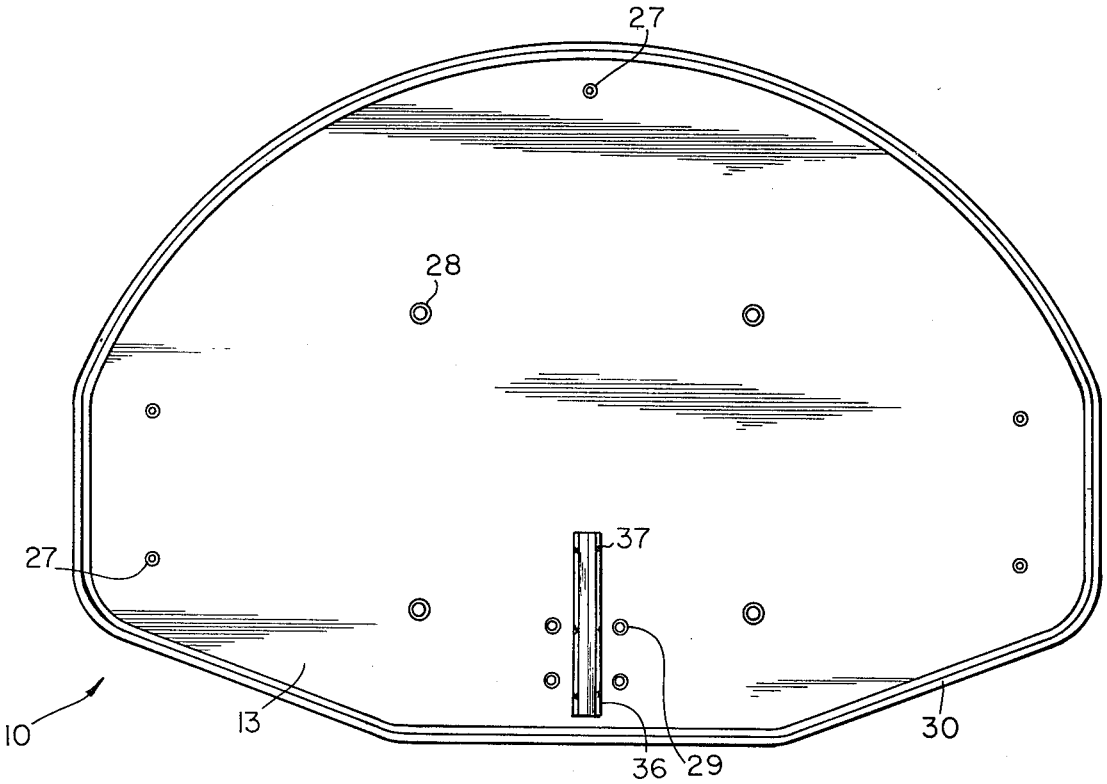
FIG. 2 is a rear view of the backboard apparatus of FIG. 1.

Referring in particular to FIGS. 1 and 2, the preferred locations for the various securement and mounting means are indicated. The securement means as shown in FIG. 3 are preferably located at the five outside locations such as indicated at 27. The mounting means such as shown in FIG. 4 are preferably located at four locations, such as 28, arranged in a rectangular array for securement to a suitable support. Further mounting means substantially identical to that shown in FIG. 4 are located at a smaller rectangular array, such as shown at 29, to provide for the mounting of a basketball goal to the backboard in usual fashion.

The basketball backboard apparatus 10 further includes a border attached to the perimetric edge of the sandwich board 11. This border 30 is substantially softer than the front and rear panels and thereby provides a soft edge to the backboard to minimize the possibility of injury, and also to provide a more aesthetic and finished appearance to the backboard apparatus 10. As shown particularly in FIG. 5, the border 30 may preferably comprise an integral, unitary material formed, for example, by extrusion in an elongated continuous length. The border may suitably be comprised of a soft, attractive vinyl material or any other suitable composition. The border 30 is preferably attached to the perimetric edges of the front and rear panels. These edges 31 and 32 are preferably angled inwardly and are received within longitudinal recesses, such as 33, in the border 30. Further, the border preferably includes a pair of projections 34 which are received between the front and rear panels and serve to resiliently hold the border with the edges 31 and 32 received in the respective recesses such as 33.

Figure 6:
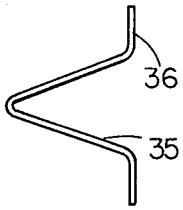
FIG. 6 is an end view of a preferred embodiment of a brace member useful with the backboard apparatus of FIG. 1.

The backboard apparatus 10 also preferably includes a brace member 35 (FIG. 2) mounted at the center portion of the backboard along the rear panel. The brace member preferably has a generally V-shaped cross section, as shown particularly in FIG. 6. The brace member also includes a pair of outwardly extending flanges, such as 36, to facilitate mounting of the brace member to the rear panel such as by spot welds as indicated at 37. The brace member is particularly desirable to provide additional support at the location of the basketball goal, which receives considerable forces during the coarse of a basketball game. As shown in FIG. 2, the brace member is preferably mounted to extend between the mounting locations for the basketball goal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A basketball backboard apparatus which comprises:

a sandwich board shaped in the form of a basketball backboard and having a perimetric edge, said sandwich board including front and rear spaced-apart rigid panels, and an intermediate resilient layer positioned between the front and rear panels, said front and rear panels including edges extending outwardly of the intermediate layer;

securement means for securing together the front and rear panels and the intermediate layer of said sandwich board in an adjacent, sandwich relationship;

a border attached to the perimetric edge of said sandwich board, said border being substantially softer than the front and rear panels and including a pair of recesses within which the edges of the front and rear panels are received; and mounting means for mounting said sandwich board to an external backboard support.

2. The apparatus of claim 1 in which said border comprises an integral, elongated length of material.

3. The apparatus of claim 2 in which said sandwich board defines several securement apertures and said securement means includes several rivets extending through the securement apertures and securing together the front and rear panels and the intermediate layer of said sandwich board.

4. The apparatus of claim 3 and which further includes a brace member secured to the back panel of said sandwich board.

5. The apparatus of claim 4 in which said mounting means includes said sandwich board defining several mounting apertures extending through the front and rear panels and the intermediate layer.

* * * * *